United States Patent [19]

Kobayashi

[11] 4,036,002

[45] July 19, 1977

[54] DIRT REMOVAL IN SPINNING DEVICE

[75] Inventor: Akira Kobayashi, Ohbu, Japan

[73] Assignees: Kabushiki Kaisha Toyoda Jidoshokki Seisakusho; Daiwa Boseki Kabushiki Kaisha, Osaka, both of Japan

[21] Appl. No.: 659,850

[22] Filed: Feb. 20, 1976

Related U.S. Application Data

[63] Continuation-in-part of Ser. No. 518,945, Oct. 29, 1974, abandoned.

[30] Foreign Application Priority Data

Nov. 1, 1973 Japan ..... 48-127433

[51] Int. Cl.[2] ..... D01H 7/02

[52] U.S. Cl. ..... 57/58.89; 57/56; 57/58.95

[58] Field of Search ..... 19/105; 57/58.89, 58.95, 57/56

[56] References Cited

U.S. PATENT DOCUMENTS

| | | | |
|---|---|---|---|
| 3,792,575 | 2/1974 | Doudlebsky et al. | 57/58.89 X |
| 3,797,218 | 3/1974 | Landwehrkamp et al. | 57/58.89 |

*Primary Examiner*—Dorsey Newton

*Attorney, Agent, or Firm*—Wenderoth, Lind & Ponack

[57] ABSTRACT

In a spinning device of an open end spinning machine, a silver is fed to and passes through a feeding and opening device which opens the silver into individual fibers and feeds them into a rotary spinning chamber where they are collected and discharged as a finished yarn therefrom. In order to clean the fibers, when they pass through the feeding and opening device, dirt of the fibers is adapted to be thrown out by centrifugal force and leaves the fibers through a dirt discharge opening and enters through an intermediate duct into a dirt collecting chamber. The chamber is provided with an air inlet opening into the atmosphere and an air outlet connected with a source of negative pressure to produce a current of air which flows through the air inlet and outlet and by which the dirt collected in the chamber is continuously removed out of the chamber. A part of the air current tends to be directed through the intermediate duct to the dirt discharge opening. However, the intermediate duct has a portion with a cross-sectional area sufficiently smaller than that of the dirt collecting chamber so that the speed of that part of the air current becomes smaller than a terminal speed of the dirt.

3 Claims, 4 Drawing Figures

DIRT REMOVAL IN SPINNING DEVICE

This application is a continuation-in-part of application Ser. No. 518,945, filed Oct. 29, 1974 now abandoned.

BACKGROUND OF THE INVENTION

This invention relates to a spinning device for open end spinning machines, and more particularly to dirt removal in the spinning device.

As is well known in the art, there is a spinning device for an open end spinning machine of the type comprising a rotary spinning chamber, feeding and combing means for feeding a supplied sliver into the rotary spinning chamber, and a discharge channel through which the finished yarn is withdrawn. The feeding and combing means includes a combing roller to which the sliver is fed and combed out into individual fibers. By the combing roller, the individual fibers are fed to a removal position thereof and hence into the rotating spinning chamber. On the way of the individual fibers to the removal position, there is a dirt discharging opening through which dirt contained in the sliver, such as pusks, neps or short fibers having a length shorter than the width of the dirt discharge opening, is thrown out by centrifugal force toward a dirt collecting chamber. The dirt collecting chamber is provided with an air inlet and outlet to produce an air current flowing therethrough, thereby continuously removing the dirt particles out of the dirt collecting chamber. In order to prevent the fibers from passing out through the dirt discharge opening, that is to carry out an efficient separation of the dirt from the fibers, there is a dirt separating channel through which an air current is introduced into the fibers at a position near the dirt discharge opening.

In such a conventional spinning device, a part of the air current flowing through the air inlet into the outlet tends to flow into the fibers along with the air current passing through the dirt separating channel, whereby the dirt particles once contained in the dirt collecting chamber are moved back toward the dirt discharge opening. This unfavourably affects the separation of the dirt from the fibers, resulting in a poor cleanliness of the finished yarn.

One of possible methods for eliminating this disadvantage is to decrease a velocity of the air current flowing through the air inlet and outlet provided in the dirt collecting chamber. However, the decreased velocity of the air current is accompanied by a poor removal of the dirt particles contained in the dirt collecting chamber and therefore this method can not be brought into practice.

SUMMARY OF THE INVENTION

Therefore, this invention relates to improvements in the above - discussed type of the conventional spinning device and has for its object the provision of an improved fiber spinning device, which eliminates the disadvantages of the conventional spinning device of the type described above.

According to an arrangement of the present invention for continously removing dirt from a sliver in a spinning device of the type described, an intermediate longitudinal duct is disposed between a dirt discharge opening and dirt collecting chamber, the duct being dimensioned for maintaining the speed of an air current passing through the dirt collecting chamber which tends to move from the dirt collection chamber to the dirt discharge opening below a value which would prevent dirt from moving from the dirt discharge opening to the dirt collection chamber. Therefore, the dirt particles once passed through the dirt discharge opening are not moved back into the fibers.

BRIEF DESCRIPTION OF THE DRAWINGS

The invention will become more readily apparent from the following detailed description taken in conjunction with the accompanying drawings in which similar reference numerals denote the same or corresponding components throughout the figures and in which.

DESCRIPTION OF THE INVENTION

Figure 1:
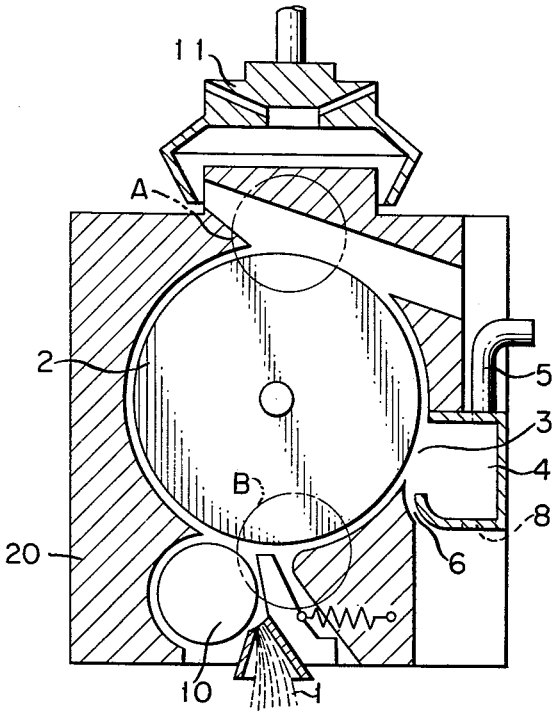
FIG. 1 PRIOR ART
FIG. 1 is a section showing a prior art spinning device.
Figure 2:
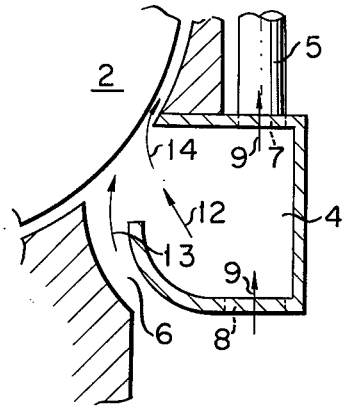
PRIOR ART FIG. 2
FIG. 2 is an enlarged fragmental sectional view showing a dirt collecting chamber of the spinning device of FIG. 1.

Referring now to the drawings, there is shown in FIGS. 1 and 2 a prior art spinning device of an open end spinning machine in which a supplied sliver 1 is fed by means of a feed roller 10 to a combing position B where it is opened out into individual fibers. The individual fibers are fed by a combing roller 2 (which is provided with a conventional fibergripping surface) to a doffing position A through which they are introduced into a rotary spinning chamber of a rotor 11 so that the fibers are spun and produce a yarn in a conventional manner. On the way of the fibers from the position B to A, there is provided a dirt discharge opening 3 in a wall of housing 20 for the feed roller 10 and combing roller 2 in order to allow dirt such as pusks or neps of the sliver, which is denser than the fiber, to be thrown out by centrifugal force through the dirt discharge opening into a dirt collecting chamber 4. The chamber 4 is provided with an air inlet 8 opening into the atmosphere and an air outlet 7 connected through a pipe 5 with a source of negative pressure (not shown). Therefore, an air current 9 is produced in the dirt collecting chamber 4, whereby the dirt is removed from the chamber 4. Furthermore, to carry out an effective separation of the dirt from the sliver at the position of the dirt discharge opening 3, there is provided a separation channel 6 on the upstream side of the dirt discharge opening 3, the channel 6 being in fluid communication with the atmosphere. In such a spinning device, a part of the air current 9 tends to flow through the dirt discharge opening 3 to the combing roller 2 as shown by an arrow 12 and an air current 13 passing through the channel 6 is directed opposite to the direction of movement of the dirt, these air currents being combined and introduced into the fibers as shown by an arrow 14. Therefore, it is understood that some of the dirt particles once thrown out into the dirt collecting chamber 4 tend to be moved back toward the combing roller 2 due to the presence of the air current 12. This results in an insufficient separation of the dirt particles.

Figure 3:
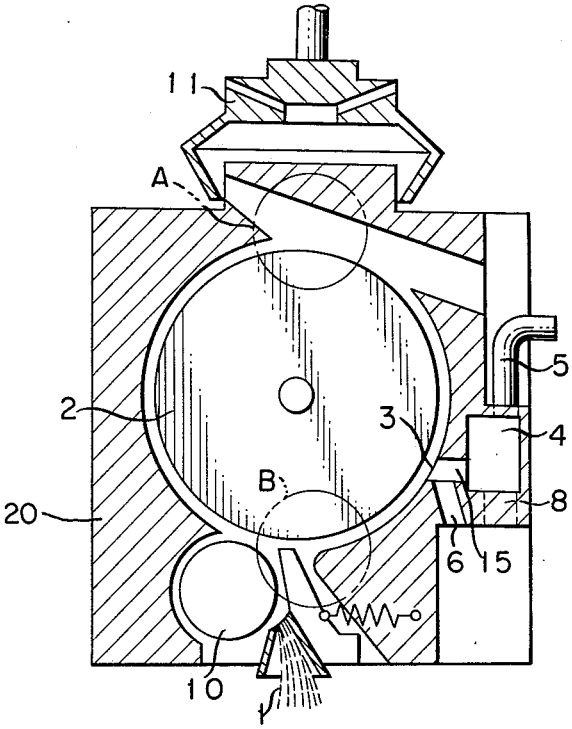
FIGS. 3 and 4 are views corresponding to FIGS. 1 and 2, showing an embodiment of the present invention.
Figure 4:
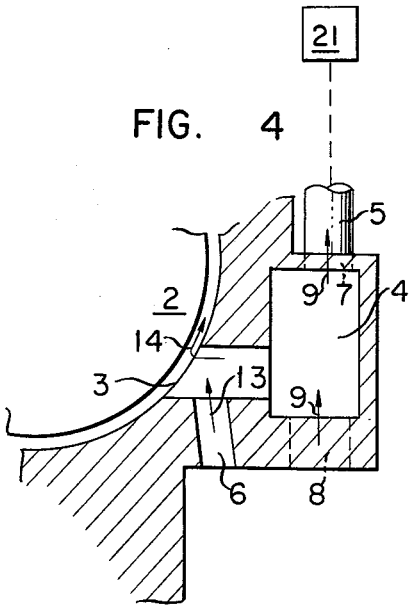

In FIGS. 3 and 4, there is shown an improved spinning device constructed in accordance with the principles of the present invention, which makes it possible to achieve an effective removal of dirt by preventing the once removed dirt particles from moving back into the fibers.

In the spinning device of the invention, a dirt discharge opening 3 is not in direct connection with a dirt collecting chamber 4, but is connected through an intermediate duct 15 therewith. A separation channel 6 preferably opens into the intermediate duct 15 at a position near the dirt discharge opening 3 so that an air current 13 is introduced into the fibers against running out movement of the dirt particles as in the prior spinning device. The dirt collecting chamber 4 is provided with an air inlet 8 opening into the atmosphere and an air outlet 7 connected through a pipe 5 with a suitable source of negative pressure (shown schematically at 21 in FIG. 4) to drive the dirt particles out of the dirt collecting chamber. Alternatively, air outlet 7 could be connected to the atmosphere, and air inlet 8 could be connected to a source of pressure. The important feature is that air current 9 be created to pass through chamber 4. It is essential that the intermediate duct be so dimensioned that the dirt particles thrown out through the dirt discharge opening 3 can smoothly pass therethrough and to the chamber 4, but that backward movement, toward the fibers, of the dirt particles once contained in the chamber 4 and/or on the way to the chamber 4 is not allowed. Therefore, the intermediate duct 15 has a considerably small diameter relative to a longitudinal length of the dirt collecting chamber 4 as clearly shown in FIGS. 3 and 4 so that the speed of a portion of the air current tending to move from the dirt collection chamber to the dirt discharge opening is maintained below a value which would prevent dirt from moving from the dirt discharge opening to the dirt collection chamber.

In such a spinning device, an air current 9 is produced in the chamber 4 as shown by the arrow in FIG. 4 while an air current 14 flowing into the combing roller 2 consists of mainly an air current 13 passing through the separation channel 6 due to the choke function of the intermediate duct 15. That is, a part of the air current 9, which flows toward the dirt discharge opening 3, may or may not be generated since the intermediate duct is appropriately decreased in cross sectional area relative to the dirt collecting chamber 4. Thus, even if generated, its speed is limited below a terminal velocity of the dirt particles, i.e. a speed which causes the moving dirt particles to stop.

It will be apparent from the description below that the throttling function of the intermediate longitudinal duct 15 is very effective for dirt separation.

Terminal speeds of various impurities are shown in the accompanying table.

Terminal Speed of Impurities, in cm/sec

| | Average Diameter, in milimeters | | | | |
|---|---|---|---|---|---|
| Impurity | 0.5–1.0 | 1.0–1.5 | 1.5–2.0 | 2.0–2.5 | above 2.5 |
| Crushed Leave | 50–80 | 55–70 | 55–130 | 35–130 | 25–100 |
| Crushed Seed | 10–20 | 50–110 | 35–110 | 35–140 | 60–125 |
| lint: Consisting of Single Fiber | | | 3–10 | | |
| lint: Consisting of Several Fibers | | | 5–20 | | |
| Available Fiber | | | 5–20 | | |

According to an experiment of the inventor, it has been found that if the air current passing from the air inlet 8 through the intermediate duct 15 to the dirt discharge opening is throttled to have a speed of about 30 – 50 cm/sec, then about 75 – 80% of the impurities contained in the fiber material will be removed therefrom, and the length of time between stoppages clean up dirt collected in the rotor can be increased to four times as long as that possible with the prior art spinning device shown in FIGS. 1 and 2.

Further experiments have been made under the geometrical conditions that diameters of the air inlet 8, outlet 7, separation channel 6 and dirt collecting chamber 4 are 8, 10, 5 and 12 milimeters respectively and height of the dirt collecting chamber 4 is 30 milimeters. In the case of the 5 mm diameter duct 15, 0.52 gr. of impurities were removed for 1 Kg. of spun yarn. However, in the case of the diameter of the duct 15 being decreased to 8 milimeters under the same conditions, only 0.01 gr. of impurities were removed for 1 Kg. of spun yarn. In the latter case, a problem was experienced that some impurities once contained in the chamber 4 are moved back toward and caught by the combing roller. This causes the agglomerated impurities to simultaneously enter the rotor 11, thus resulting in frequent occurrences of yarn breakage at intervals of about 30 minutes.

Thus, it is appreciated that to throttle the air current flowing from the air inlet 8 through the intermediate duct 15 to the dirt discharge opening 3 is effective for providing a good yarn quality and for decreasing the number of yarn breakages or the rotor cleaning cycle.

It is therefore understood that the dirt particles once passed through the dirt discharge opening 3 are completely removed from the dirt collecting chamber 4 to accomplish an effective removal of the dirt particles from the fibers, resulting in a high quality of finished yarn. In addition, the possibility that the dirt is collected in the rotor can be avoided and hence there is no need for cleaning dirt from the rotor.

What I claim is:

1. A fiber spinning device comprising:

a rotary spinning chamber;

a housing;

means cooperating with said housing for combing a sliver into individual fibers and feeding said fibers along a path to said rotary spinning chamber;

means communicating with said path for continuously removing dirt from said fibers during the operation of said combing means, said dirt removing means comprising:

a dirt discharge opening in said housing communicating with said path;

a dirt collection chamber positioned to receive therein dirt passing through said discharge opening;

an air inlet and an air outlet opening into said dirt collection chamber;

means connected to one of said air inlet and said air outlet for continuously creating an air current through said dirt collection chamber to continuously remove dirt therefrom during the operation of said combing and feeding means; and throttling means for throttling and maintaining the speed of a portion of said air current tending to move from said dirt collection chamber to said dirt discharge opening below a value which would prevent dirt from moving from said dirt discharge opening to said dirt collection chamber, said throttling means comprising a longitudinal duct connecting said dirt discharge opening and said dirt collection chamber, said longitudinal duct having a transverse cross-sectional area substantially smaller than that of said dirt collection chamber, said cross-sectional area being substantially uniform throughout the entire length thereof; and air supply duct means opening into said longitudinal duct adjacent said dirt discharge opening for supplying air to said path to prevent fibers from passing from said path through said dirt discharge opening.

2. The improvement claimed in claim 1, wherein said air supply duct means is directed toward said dirt discharge opening.

3. The improvement claimed in claim 1, wherein said longitudinal duct extends in a straight path between said dirt discharge opening and said dirt collection chamber.

* * * * *